US009238860B2

(12) United States Patent
Yamada et al.

(10) Patent No.: US 9,238,860 B2
(45) Date of Patent: Jan. 19, 2016

(54) METHOD OF CARRYING OUT POST-TREATMENT TO SPRAYED COATING AND AGENT USED FOR THE SAME

(71) Applicants: FUJIGIKEN CO., LTD., Osaka (JP); FUJI ENGINEERING CO., LTD., Osaka (JP); WEST NIPPON EXPRESSWAY COMPANY LIMITED, Osaka (JP)

(72) Inventors: Kenichi Yamada, Fukuoka (JP); Keisuke Fujikawa, Fukuoka (JP); Masanobu Sugimoto, Osaka (JP)

(73) Assignees: FUJIGIKEN CO., LTD., Osaka (JP); FUJI ENGINEERING CO., LTD, Osaka (JP); WEST NIPPON EXPRESSWAY COMPANY LIMITED, Osaka (JP)

( * ) Notice: Subject to any disclaimer, the term of this patent is extended or adjusted under 35 U.S.C. 154(b) by 37 days.

(21) Appl. No.: 13/716,703

(22) Filed: Dec. 17, 2012

(65) Prior Publication Data

US 2014/0170323 A1 Jun. 19, 2014

(51) Int. Cl.

| | |
|---|---|
| ***C23C 4/18*** | (2006.01) |
| ***C23C 4/08*** | (2006.01) |
| *B05D 1/36* | (2006.01) |

(52) U.S. Cl.

CPC ... *C23C 4/18* (2013.01); *C23C 4/08* (2013.01); *B05D 1/36* (2013.01)

(58) Field of Classification Search

CPC ..... C23C 4/18; B05D 1/36
USPC ..... 427/405
See application file for complete search history.

(56) References Cited

U.S. PATENT DOCUMENTS

| | | | | |
|---|---|---|---|---|
| 4,444,804 | A * | 4/1984 | Ferrari | B05D 7/14 427/270 |
| 6,562,474 | B1 * | 5/2003 | Yoshimi et al. | 428/472.3 |
| 2007/0054062 | A1 * | 3/2007 | Imaizumi et al. | 427/446 |
| 2007/0114670 | A1 | 5/2007 | Shimada et al. | |
| 2009/0136781 | A1 | 5/2009 | Damani et al. | |

FOREIGN PATENT DOCUMENTS

| | | | |
|---|---|---|---|
| JP | 2-232352 | | 9/1990 |
| JP | 02232352 | A * | 9/1990 |
| JP | 11-229162 | | 8/1999 |
| JP | 11229162 | A * | 8/1999 |
| JP | 11-302820 | | 11/1999 |
| JP | 2005-15835 | | 1/2005 |
| JP | 2007-291440 | | 11/2007 |

(Continued)

OTHER PUBLICATIONS

Seawater Composition, Marine Science, Oct. 8, 2008, found at http://www.marinebio.net/marinescience/02ocean/swcomposition.htm.*

(Continued)

*Primary Examiner* — James M Mellot
(74) *Attorney, Agent, or Firm* — Wenderoth, Lind & Ponack, L.L.P.

(57) ABSTRACT

A method of carrying out post-treatment to a sprayed coating includes spraying aluminum-containing material onto a surface of a steel for forming a sprayed coating on the steel, and coating electrolytic aqueous solution or water base paint containing electrolytic aqueous solution therein onto the sprayed coating.

2 Claims, 2 Drawing Sheets

(56) References Cited

FOREIGN PATENT DOCUMENTS

| | | |
|---|---|---|
| JP | 2009-46765 | 3/2009 |
| WO | 2005/035829 | 4/2005 |

OTHER PUBLICATIONS

English translation of Japanese Office Action issued Mar. 4, 2014 in corresponding Japanese Patent Application No. P2010-212494.

* cited by examiner

METHOD OF CARRYING OUT POST-TREATMENT TO SPRAYED COATING AND AGENT USED FOR THE SAME

BACKGROUND OF THE INVENTION

1. Field of the Invention

The present invention relates to a method of carrying out post-treatment to a sprayed coating formed for the purpose of prevent corrosion of steel materials containing iron as a primary constituent, such as carbon steel, nickel-chromium or stainless steel, used outdoors in a bridge, port facilities, a plant, a pipe, an advertising tower, a display tower, a train, and a ship, for instance. The present invention further relates to an agent used in the method.

2. Description of the Related Art

A method of anti-corrosion spraying carried out for anti-corrosion of steel used outdoors, such as a bridge, port facilities, a plant, a pipe, an advertising tower, a display tower, a train, and a ship is defined in Japanese Industrial Standard (JIS) H8300, in which, spraying zinc, aluminum and alloys thereof is standardized. Among those metals, pure zinc, pure aluminum, zinc-aluminum alloy, and aluminum-magnesium alloy are particularly recommended as a material to be sprayed.

Among the recommended metals, pure aluminum has high resistance to acid and heat, and hence, is used not only outdoors, but also for anti-corrosion of a plant, a tank and chemical facilities, and so on. However, spotted rust is often generated on a sprayed coating early after pure aluminum was sprayed, particularly in a week after pure aluminum was sprayed.

Herein, spotted rust is a phenomenon in which water and/or humidity reach an interface between a steel and a sprayed coating, and forms a cell, resulting in that iron ions generated through the steel pass through through-holes formed in the sprayed coating and reach a surface of the sprayed coating, and then, are oxidized by air, and thus, spotted red rust are generated on a surface of the sprayed coating. Spotted rust is generally generated on a sprayed coating having a self potential higher than the same of iron, such as a sprayed coating composed of NiCr steel or stainless steel. However, polarity is reversed due to various environmental conditions even in a sprayed coating composed of aluminum alloy having a self potential lower than the same of iron, with the result that spotted rust is generated on the sprayed coating. Once spotted rust is generated, a sprayed coating is accelerated to be worn out, and thus, has a shortened lifetime. Furthermore, even if a new sprayed coating is formed over an old sprayed coating on which spotted rust is generated, adhesion and anti-corrosion of the old sprayed coating are already deteriorated, and hence, it is necessary to entirely peel off the old sprayed coating and form a new sprayed coating, resulting in a big loss in a construction period and costs.

Spotted rust is often generated particularly in outdoor environment in the case that a sprayed coating is thin, it takes much time from spraying until sealing, or a sprayed coating is insufficiently sealed. Accordingly, when pure aluminum is used for forming a sprayed coating, it is necessary to design a sprayed coating to have a sufficient thickness, tighten time management to be carried out from spraying till sealing, or carry out sealing and coating to a degree more than necessary.

Aluminum-magnesium (95:5) alloy, another recommended metal, is much used for anti-corrosion of an oil excavating plant in oil fields in the North Sea, and exhibits superior anti-corrosion performance. Aluminum-magnesium alloy is recommended also in International Organization for Standardization (ISO) 2063. However, if aluminum-magnesium alloy is actually used in outdoor environments, it is soon worn out due to environmental conditions or a certain spraying process, and spotted rust is often generated on a sprayed coating early after aluminum-magnesium alloy was sprayed, particularly in a week after sprayed. Thus, a sprayed coating composed of aluminum-magnesium alloy is short in stability. Accordingly, similarly to a sprayed coating composed of pure aluminum, it is necessary to design a sprayed coating to have a sufficient thickness, tighten time management to be carried out from spraying till sealing, or carry out sealing and coating to a degree more than necessary.

For instance, various Publications have suggested a process of sealing.

Japanese Patent Application Publication No. H11(1999)-302820 has suggested a sealing process including the step of coating a material having a high viscosity or a high polymer material containing sulfate having a high melting point, as a primary constituent, to thereby fill therewith spaces formed in a sprayed coating, for the purpose of enhancing anti-corrosion in high-temperature corrosive environment.

Japanese Re-Publication No. 2005-35829 has suggested a sealing process including the steps of coating a material having a resistance against high temperature, particularly hot water and humidity, onto aluminum for forming a sprayed coating thereon, and causing aluminum exposed in spaces formed in a sprayed coating to react with moisture in how water or humidity to thereby form aluminum hydrate for sealing.

Japanese Patent Application Publication No. 2005-15835 has suggested a sealing process including the step of coating alkali silicate aqueous solution onto a sprayed coating composed of zinc, aluminum or zinc/aluminum pseudo-alloy to thereby compose insoluble complex salt.

Japanese Patent Application Publication No. 2007-291440 has suggested a sealing process including the step of coating a sealer composed of a mixture of water-soluble polymer emulsion, colloidal silica, and active silicon water repellent to thereby form a sealed coating.

Japanese Patent Application Publication No. 2009-46765 has suggested a sealing process including the steps of coating nitrate or acetate onto a surface of a sprayed coating, and sintering the nitrate or acetate by heating to thereby form metallic oxide for the purpose of enhancing heat-resistance and corrosion-resistance in high temperature environment.

The above-mentioned countermeasures to rusting and being early worn out in a sprayed coating composed of aluminum have problems as follows.

Designing a sprayed coating to have a great thickness not only causes waste of resources, but also lengthens a construction period, resulting in cost-up in a spraying construction and deterioration of competitive power. In addition, carrying out sealing and painting to a degree more than necessary not only causes waste of resources, but also causes cost-up in a construction, and further, causes much use of volatile organic compounds (VOC) having a half of a weight of paints. This is considered a material for causing the earth to warm up, and hence, exerting a harmful influence to the environment.

A sprayed coating formed for the purpose of anti-corrosion is designed to have a thickness determined in accordance with a lifetime predetermined in line with environments. In general, a sprayed coating having a greater thickness has a longer lifetime. In Japanese Industrial Standard (JIS) H8300, whereas a sprayed coating composed of zinc, for instance, pure zinc or zinc-aluminum alloy, is recommended to have a thickness of 50 micrometers or greater, a sprayed coating composed of aluminum, for instance, pure aluminum or aluminum-magnesium alloy is recommended to have a thickness of 100 micrometers or greater. This is considered because aluminum tends to be readily rusted. If it were possible to prevent rusting, a sprayed coating could have a thickness determined in accordance with a lifetime thereof. That is, if a sprayed coating had a short lifetime, the sprayed coating could have a small thickness with the result of reduction in costs of a construction.

SUMMARY OF THE INVENTION

In view of the above-mentioned problems in the conventional methods, it is an object of the present invention to provide a method of carrying out post-treatment to a sprayed coating, and a post-treatment agent, both of which are capable of preventing a sprayed coating composed of aluminum from rusting and being early worn out, without designing a sprayed coating to have a sufficient thickness, tightening time management to be carried out from spraying till sealing, and excessively carrying out sealing and coating.

In one aspect of the present invention, there is provided a method of carrying out post-treatment to a sprayed coating, including spraying aluminum-containing material onto a surface of a steel for forming a sprayed coating on the steel, and coating one of electrolytic aqueous solution and water base paint containing electrolytic aqueous solution therein onto the sprayed coating.

It is preferable that the electrolytic aqueous solution reaches at a surface of the steel through spaces formed in the sprayed coating, and forms a cell between the steel and the sprayed coating.

It is preferable that the electrolytic aqueous solution comprises magnesium compound aqueous solution, and magnesium ions contained in the magnesium compound aqueous solution separate onto a surface of the steel, and forms a coating containing magnesium hydroxide as a primary constituent.

It is preferable that the electrolytic aqueous solution comprises chloride aqueous solution, chloride ions contained in the chloride aqueous solution activate cell reaction, and aluminum contained in the sprayed coating prevents the sprayed coating from being in a passive state to keep a potential of the sprayed coating low.

It is preferable that the sprayed coating is composed of aluminum-magnesium alloy.

In another aspect of the present invention, there is provided an agent used for carrying out post-treatment to a sprayed coating formed on a steel by spraying aluminum-containing material onto a surface of the steel, the agent containing one of electrolytic aqueous solution and water base paint containing electrolytic aqueous solution therein.

In order to prevent a steel from being corroded, it is necessary that a current having a predetermined intensity or greater runs between a steel and a sprayed coating. A necessary intensity of a current for anti-corrosion is in dependence on an amount of oxygen to be supplied to a surface of a steel. In the method and the agent both in accordance with the present invention, coated electrolytic aqueous solution or electrolytic aqueous solution contained in water base paint is impregnated through spaces formed in a sprayed coating, reaches at an interface between a steel and a sprayed coating, and forms a cell.

In the case that electrolytic aqueous solution comprises magnesium compound aqueous solution, magnesium ions contained in the magnesium compound aqueous solution appear in a surface of a steel, and forms a coating containing magnesium hydroxide as a primary constituent. As a result, a current running between a steel and a sprayed coating is reduced, and thus, oxygen is difficult to reach at a steel. Consequently, a steel is prevented from being rusted, and further prevented from being early worn out. As magnesium compound aqueous solution, there may be used aqueous solution of magnesium sulfate, magnesium nitrate or magnesium chloride.

In the case that electrolytic aqueous solution comprises chloride aqueous solution, chloride ions contained in the chloride aqueous solution activate cell reaction, and aluminum contained in the sprayed coating prevents the sprayed coating from being in a passive state. Thus, it is possible to keep a potential of the sprayed coating low, and a steel is prevented from being rusted, and further prevented from being early worn out. As chloride aqueous solution, there may be used aqueous solution of sodium chloride, ammonium chloride or magnesium chloride.

In particular, in the case that a sprayed coating is composed of aluminum-magnesium alloy, chloride ions, sulphate ions and/or nitrate ions contained in an electrolytic aqueous solution facilitate magnesium ions to be precipitated out of a sprayed coating, and to reach a steel, resulting in that a sprayed coating composed of magnesium compound and coating a steel therewith has a great thickness, and hence, a steel is prevented from being rusted and being early worn out.

Furthermore, in the above-mentioned case, adding magnesium compound aqueous solution to magnesium ions precipitated out of a sprayed coating, an amount of magnesium ions naturally increases, resulting in that an amount of precipitated magnesium hydroxide increases, and hence, a sprayed coating composed of magnesium compound and coating a steel therewith has a further increased thickness. Consequently, a steel is further prevented from being rusted and being early worn out.

In still another aspect of the present invention, there is provided a method of carrying out post-treatment to a sprayed coating, including spraying aluminum-containing material onto a surface of a steel for forming a sprayed coating on the steel, coating electrolytic aqueous solution a onto the steel, drying the electrolytic aqueous solution, and coating water base paint onto the sprayed coating.

A steel is prevented from being rusted by spraying aluminum-containing material onto a surface of a steel for forming a sprayed coating on the steel, coating electrolytic aqueous solution onto the steel, and drying the electrolytic aqueous solution. Thus, it is possible to use water base paint to be coated onto a sprayed coating, for the purpose of heavy duty anti-corrosion.

The advantages obtained by the aforementioned present invention will be described hereinbelow.

In the present invention, the coated electrolytic aqueous solution or electrolytic aqueous solution contained in the coated water base paint penetrates into a sprayed coating through spaces formed in the sprayed coating, reaches at an interface between a steel and the sprayed coating, and forms a cell there. As a result, in the case that the electrolytic aqueous solution comprises magnesium compound aqueous solution, a coating containing magnesium hydroxide as a primary constituent is formed at a surface of the steel. Thus, a current running between the steel and the sprayed coating is reduced, and thus, oxygen is difficult to reach at the steel. Consequently, the steel is prevented from being rusted, and further prevented from being early worn out. Accordingly, a sprayed coating can be designed to have a thickness in accordance with a lifetime thereof. If a sprayed coating has a short lifetime, the sprayed coating can be designed to have a small thickness, ensuring reduction in construction costs. Furthermore, by using water base paint containing electrolytic aqueous solution therein, it is possible to use the water base paint which is superior as environmental countermeasures, for the purpose of heavy duty anti-corrosion.

In the case that the electrolytic aqueous solution comprises chloride aqueous solution, chloride ions contained in the chloride aqueous solution activate cell reaction, and aluminum contained in the sprayed coating prevents the sprayed coating from being in a passive state. Thus, it is possible to keep a potential of the sprayed coating low, and a steel is prevented from being rusted, and further prevented from being early worn out.

In particular, in the case that a sprayed coating is composed of aluminum-magnesium alloy, chloride ions, sulphate ions and/or nitrate ions contained in the electrolytic aqueous solution facilitate magnesium ions to be precipitated out of a sprayed coating, and to reach a steel, resulting in that a sprayed coating composed of magnesium compound and coating a steel therewith has a great thickness, and hence, a steel is further prevented from being rusted and being early worn out.

Furthermore, in the above-mentioned case, adding magnesium compound aqueous solution to magnesium ions precipitated out of a sprayed coating, an amount of magnesium ions naturally increases, resulting in that an amount of precipitated magnesium hydroxide increases, and hence, a sprayed coating composed of magnesium compound and coating a steel therewith has a further increased thickness. Consequently, a steel is further prevented from being rusted and being early worn out.

A steel is prevented from being rusted by spraying aluminum-containing material onto a surface thereof for forming a sprayed coating thereon, coating electrolytic aqueous solution thereonto, drying the electrolytic aqueous solution, and coating water base paint thereonto. Thus, it is possible to use water base paint which is superior as environmental countermeasures, for the purpose of heavy duty anti-corrosion.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Hereinbelow is explained the anti-corrosion process in accordance with the first embodiment of the present invention.

Figure 1:
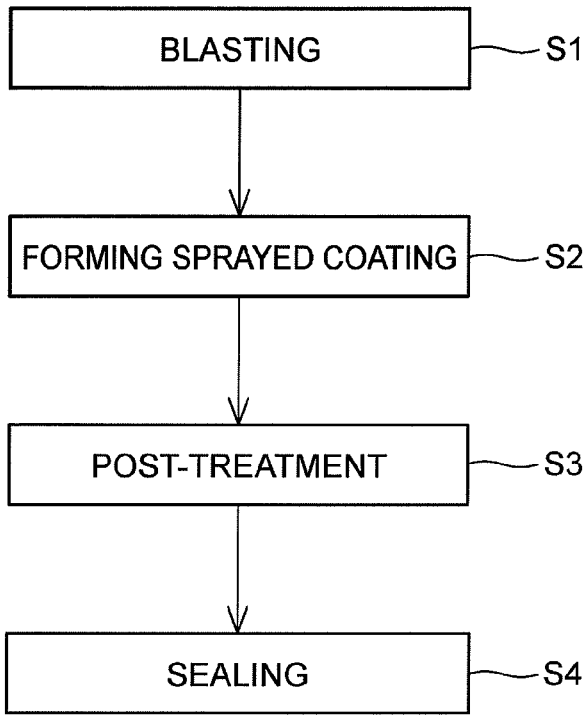
FIG. 1 is a flow chart showing the steps to be carried out for anti-corrosion in the first embodiment of the present invention.
Figure 2:
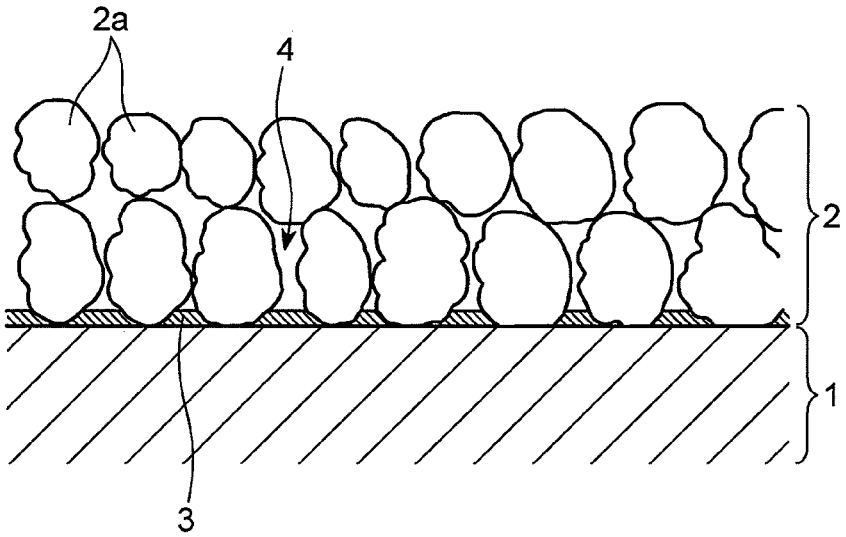
FIG. 2 is an enlarged cross-sectional view of a surface of a steel to which the anti-corrosion process in accordance with the first embodiment of the present invention is applied.

FIG. 1 is a flow chart showing the steps to be carried out for anti-corrosion in the first embodiment of the present invention, and FIG. 2 is an enlarged cross-sectional view of a surface of a steel to which the anti-corrosion process in accordance with the first embodiment of the present invention is applied.

As illustrated in FIG. 1, the anti-corrosion process in accordance with the first embodiment of the present invention includes steps of blasting a steel (S1), and forming a sprayed coating composed mainly of aluminum (S2). The blasting is carried out at Sa2 to Sa3. The sprayed coating has a thickness in the range of 50 to 500 micrometers both inclusive, preferably, in the range of 100 to 200 micrometers both inclusive, as recommended in Japanese Industrial Standard (JIS) H8300. The sprayed coating is formed by spraying pure aluminum, zinc-aluminum alloy or aluminum-magnesium alloy by means of plasma-spraying, gas flame spraying or arc-spraying.

Then, the post-treatment is carried out to the sprayed coating (S3). The post-treatment to the sprayed coating includes the step of coating electrolytic aqueous solution acting as an agent for post-treatment to a sprayed coating, onto a sprayed coating having been formed immediately before. The electrolytic aqueous solution to be coated onto the sprayed coating comprises aqueous solution of chloride or magnesium compound. As chloride, there may be selected sodium chloride, ammonium chloride or magnesium chloride. As magnesium compound, there may be selected magnesium sulfate, magnesium nitrate or magnesium chloride. The electrolytic aqueous solution is designed to have a density in the range of 0.1 mol/liter to a solubility to water. Though it is considered that the electrolytic aqueous solution having a density of 0.1 mol/liter or smaller is able to present some advantages, the electrolytic aqueous solution would be stable potentially, if it had a density of 0.1 mol/liter or higher. In order to prevent the electrolytic aqueous solution from recrystallizing when a temperature thereof lowers, it is preferable that the electrolytic aqueous solution has a maximum solubility which is accomplished at 0 degree centigrade or lower. The electrolytic aqueous solution may be coated by means of a brush or a roller, for instance, coated with water-jet, or sprayed.

After water or electrolytic aqueous solution was coated, the sprayed coating is dried and aged. A period of time for drying the sprayed coating may be determined by touching the sprayed coating with a finger. The sprayed coating is naturally dried, but may be compulsorily dried by blowing hot air thereto.

Though the thus formed sprayed coating presents sufficient anti-corrosion performance without further carrying out any steps, the sprayed coating is sealed (S4) in general, after dried. The sprayed coating is sealed with water base paint or solvent base paint, for instance.

In accordance with the anti-corrosion process as mentioned above, the electrolytic aqueous solution coated in the post-treatment (S3) to the sprayed coating penetrates through spaces 4 formed between particles 2*a* of the sprayed coating 2, reaches at an interface between a steel and the sprayed coating 2, and forms a cell there, as illustrated in FIG. 2.

In the case that the electrolytic aqueous solution is composed of magnesium compound aqueous solution, pH increases up to about 13 by means of chemical reaction. Then, magnesium ions contained in the electrolytic aqueous solution are crystallized at a surface of the steel 1, and forms a coating 3 containing magnesium hydroxide as a primary constituent, which is hard to be soluble into alkali. The coating 3 reduces a current running between the steel 1 and the coating 2. Furthermore, since it is difficult for oxygen to arrive at the steel, the steel 1 is prevented from being rusted and being early worn out.

In the case that electrolytic aqueous solution comprises chloride aqueous solution, chloride ions contained in the chloride aqueous solution activate cell reaction, and aluminum contained in the coating 2 prevents the coating 2 from being in a passive state. Thus, a potential of the coating 2 is kept low. Consequently, similarly to the magnesium compound aqueous solution, the steel 1 is prevented from being rusted, and further prevented from being early worn out.

In particular, in the case that the coating 2 is composed of aluminum-magnesium alloy, chloride ions, sulphate ions and/or nitrate ions contained in the electrolytic aqueous solution facilitate magnesium ions to be precipitated out of the coating 2, and to reach the steel 1, resulting in that the coating 2 composed of magnesium compound and coating the steel 1 therewith has a great thickness, and hence, the steel 1 is further prevented from being rusted and being early worn out.

Furthermore, adding magnesium compound aqueous solution to magnesium ions precipitated out of the coating 2, an amount of magnesium ions naturally increases, resulting in that an amount of precipitated magnesium hydroxide increases, and hence, the coating 2 composed of magnesium compound and coating the steel 1 therewith has a further increased thickness. Consequently, the steel 1 is further prevented from being rusted and being early worn out.

In this reaction, though aluminum contained in the sprayed coating 2 are ionized, the ionized aluminum is not crystallized at a surface of the steel 1, because aluminum compound principally containing aluminum hydroxide is soluble to water in a high-pH environment.

Second Embodiment

Hereinbelow is explained the anti-corrosion process in accordance with the second embodiment of the present invention.

Figure 3:
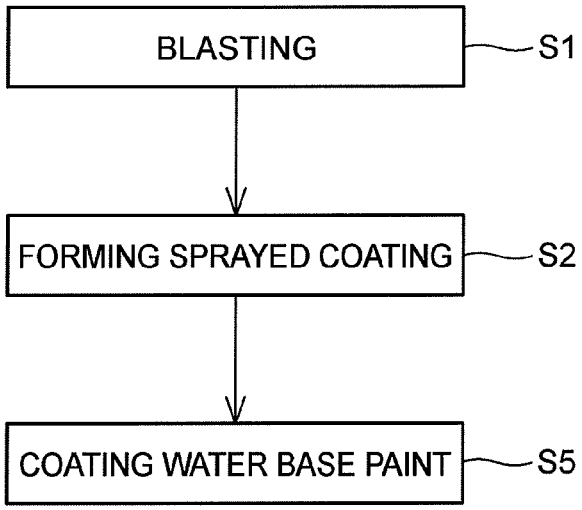
FIG. 3 is a flow chart showing the steps to be carried out for anticorrosion in the second embodiment of the present invention.

FIG. 3 is a flow chart showing the steps to be carried out for anti-corrosion in the second embodiment of the present invention.

As illustrated in FIG. 3, the anti-corrosion process in accordance with the second embodiment of the present invention includes the steps of blasting (S1) and forming a sprayed coating (S2), similarly to the first embodiment. The anti-corrosion process in accordance with the second embodiment is designed to include the steps of coating water base paint, as an agent for post-treatment to a sprayed coating, onto a sprayed coating by means of a brush or a roller (S5), and drying the sprayed coating.

In general, water is added at about 10% to water base paint for the purpose of making it easy to coat water base paint onto an object. In contrast, water base paint to be used in the second embodiment contains chloride aqueous solution or magnesium compound aqueous solution in place of water. A mixture ratio between water base paint and chloride aqueous solution or magnesium compound aqueous solution is 10:X in mass where X is in the range of 1 to 3 both inclusive. The aqueous solution has a density in the range of 0.1 mol/liter to a solubility to water.

Since water base paint does not contain volatile organic compounds (VOC) considered one of materials which warm up the earth, water base paint is expected to be used as environmental countermeasures. However, water base paint presents low anti-corrosion performance, water base paint has not been conventionally used for the purpose of heavy duty anti-corrosion. Thus, though water base paint has been suggested to use in combination with a sprayed coating, if water base paint is actually coated onto a sprayed coating, it takes much time for the sprayed coating to be completely dried due to resins contained in water base paint, resulting in that a steel is readily rusted. Furthermore, water base paint is able to solely form a cell between the steel 1 and the sprayed coating 2, but water base paint raises a potential of the sprayed coating 2, and hence, water base paint provides just small anti-corrosion performance to the steel 1.

However, the water base paint containing electrolytic aqueous solution in the second embodiment can provide the same advantages as those provided by the first embodiment, because electrolytic aqueous solution contained in coated water base paint penetrates into the sprayed coating 2 through the spaces 4 formed between the particles 2*a* of the sprayed coating 2, reaches at an interface between the steel 1 and the sprayed coating 2, and forms a cell there, and further, lowers a potential of the sprayed coating 2. Thus, it is possible to use water base paint superior as environmental countermeasure for the purpose of heavy duty anti-corrosion.

EXAMPLE 1

There was carried out the corrosion test, in which a test sample of the sprayed coating composed of aluminum in the second embodiment was prepared, and the test sample was exposed outdoors. The corrosion facilitation test is carried out generally as a brine-spraying test or a complex cyclic test. However, since brine used in these tests contains sodium chloride, one of chlorides, as a primary constituent, if brine is used in the test for facilitating a sprayed coating composed of aluminum to be corroded for the above-mentioned reasons, the brine lengthens a lifetime of the sprayed coating to contrary, and the facilitation to corrosion cannot be accomplished. Hence, it was confirmed that the facilitation to corrosion was accomplished through the use of distilled water or plain water having a high electric resistance in a pre-test. Accordingly, the corrosion facilitation test was made in Example 1 through the use of rainwater in order to realize actual environment.

Table 1 shows the specification of the test samples. In Example 1, Al-5% Mg and 99.7% Al were used for forming a sprayed coating.

TABLE 1

| Item | | Content |
|---|---|---|
| Sample | Material | Black-skin steel plate (SS400) |
| | Size | 150 × 75 × 3.2 t [mm] |
| Pre-treatment | Blast Sa3 | |
| Spraying conditions (Entirely Spraying) | Process | Plasma-spraying |
| | Materials | Al-5% Mg (Φ1.6 mm)<br>99.7% Al (Φ1.6 mm) |
| | Thickness | 50 [micrometers] |
| Impregnation | Dipping | 1 minute |
| Impregnation agents | None | |
| | Brine | anhydride |
| | Ammonium chloride | anhydride |
| | Magnesium chloride | six hydrates |
| | Magnesium sulfate | anhydride |
| | Magnesium nitrate | six hydrates |
| Sealing | Water base paint | Odefresh Si100II (commercially available from Nippon Paint Inc.) |

The test samples were exposed outdoors in a place in the sun (ordinary temperature). After starting exposing the test samples outdoors, rainwater was sprayed onto each of the test samples every 24 hours. A number of days in which the test samples were exposed outdoors was counted until the test samples were judged at eyes to be rusted. Rainwater is considered to be most close to ideal plain water in atmosphere. Furthermore, by designing a sprayed coating to have a thickness equal to a half of a thickness of a sprayed coating ordinarily formed in a construction, the test samples were facilitated to be rusted in the corrosion test.

Table 2 shows how many days were necessary for the test samples to be rusted in the outdoor exposure.

It is understood in view of Table 2 that the test samples to which the pre-treatment was carried out prior to sealing took a significantly greater number of days for starting being rusted than the test samples to which the pre-treatment was not carried out prior to sealing.

There were prepared two aqueous solutions each having a density of 0.1 mol/liter and 1 mol/liter. There were prepared three aqueous solutions containing magnesium chloride, each having a density of 0.1 mol/liter, 1 mol/liter and 2.5 mol/liter which is equal to a solubility to water at 0 degree centigrade.

TABLE 2

| Sprayed coating | Agent for impregnation | Mol density [mol/liter] | Impregnation Time | Number of days for being rusted |
|---|---|---|---|---|
| Al-5% Mg | None | — | — | 2 days later |
| | Sodium chloride | 1 | 1 min. | 4 days later |
| | | 0.1 | 1 min. | 3 days later |
| | Ammonium chloride | 1 | 1 min. | 4 days later |
| | | 0.1 | 1 min. | 3 days later |
| | Magnesium chloride (six hydrates) | 1 | 1 min. | 24 days later |
| | | 0.1 | 1 min. | 18 days later |
| | Magnesium sulfate | 1 | 1 min. | 17 days later |
| | | 0.1 | 1 min. | 12 days later |
| | Magnesium nitrate (six hydrates) | 1 | 1 min. | 17 days later |
| | | 0.1 | 1 min. | 13 days later |
| 99.7% Al | None | — | — | 2 days later |
| | Magnesium chloride (six hydrates) | 1 | 1 min. | 11 days later |
| | | 0.1 | 1 min. | 7 days later |

In the above-mentioned corrosion test, there were used the test samples in which sprayed coatings had a smaller thickness than a usual thickness, in order to evaluate changes in outlooking in a short period of time. Accordingly, natural potentials were measured after being exposed outdoors in the same days as shown in Table 2 in the test samples in which sprayed coatings had a usual thickness, to thereby evaluate a difference in a potential between a steel and a sprayed coating. Table 3 shows the test samples.

TABLE 3

| Solution | Density [mol/liter] | Coating (thickness) Not sealed | What is sprayed (Environment for potential measurement) |
|---|---|---|---|
| None | — | Steel (Blasted) | Brine<br>Rainwater |
| | | Al-5% Mg, 99.7% Al (100 μm) | Brine<br>Rainwater |
| Sodium chloride | 0.1, 1 | Al-5% Mg, 99.7% Al (100 μm) | Rainwater |
| Ammonium chloride | 1 | Al-5% Mg, 99.7% Al (100 μm) | Rainwater |
| Magnesium chloride (six hydrates) | 0.1, 1, 2.5 | Al-5% Mg, 99.7% Al (100 μm) | Rainwater |
| Magnesium sulfate | 0.1, 1 | Al-5% Mg, 99.7% Al (100 μm) | Rainwater |
| Magnesium nitrate (six hydrates) | 0.1, 1 | Al-5% Mg, 99.7% Al (100 μm) | Rainwater |

Table 4 shows differences in a potential between a steel and a sprayed coating composed of Al-5% Mg (No impregnation agent) in rainwater and brine environments, as a reference case, and Table 5 shows differences in a potential between a steel and a sprayed coating composed of 99.7% Al (No impregnation agent) in rainwater and brine environments.

In Tables 4 and 5, "◎" indicates that the potential difference is equal to or smaller than −101 mV, "○" indicates that the potential difference is in the range of −100 to −51 mV, "Δ" indicates that the potential difference is in the range of −50 to −1 mV, and "×" indicates that the potential difference is equal to or higher than 0 mV (reversal of polarity).

As is understood in view of Tables 4 and 5, it is possible to keep a desired potential difference to brine in a conventional process in which the pre-treatment is not carried out prior to sealing, but a potential difference is instable in rainwater environment, and the polarity is sometimes reversed. If the polarity is reversed, a steel solves out more readily than a sprayed coating composed of aluminum, resulting in that solved-out iron ions reach a surface of a sprayed coating, and are oxidized there. Thus, this is one of major causes for a steel to be rusted in spots.

TABLE 4

| Sprayed coating | Environment | Potential difference with steel: Initial | 1 day later | 7 days later | Judgment (polarity reversal with steel occurs ?) |
|---|---|---|---|---|---|
| Plasma-spraying/Al-5% Mg coating<br>Comparison between plain water (rainwater) environment and brine environment | | | | | |
| Al-5% Mg | Rainwater | ◎ | X | Δ | Yes |
| Al-5% Mg | Brine | ◎ | ◎ | ◎ | No |
| Gas flame spraying/Al-5% Mg coating<br>Comparison between plain water (rainwater) environment and brine environment | | | | | |
| Al-5% Mg | Rainwater | ◎ | X | Δ | Yes |
| Al-5% Mg | Brine | ◎ | ◎ | ◎ | No |
| Arc-spraying/Al-5% Mg coating<br>Comparison between plain water (rainwater) environment and brine environment | | | | | |
| Al-5% Mg | Rainwater | ◎ | X | Δ | Yes |
| Al-5% Mg | Brine | ◎ | ◎ | ◎ | No |

TABLE 5

| Sprayed coating | Environment | Potential difference with steel: Initial | 1 day later | 7 days later | Judgment (polarity reversal with steel occurs ?) |
|---|---|---|---|---|---|
| Plasma-spraying/99.7% Al coating<br>Comparison between plain water (rainwater) environment and brine environment | | | | | |
| 99.7% Al | Rainwater | ◎ | X | Δ | Yes |
| 99.7% Al | Brine | ◎ | ◎ | ◎ | No |
| Gas flame spraying/99.7% Al coating<br>Comparison between plain water (rainwater) environment and brine environment | | | | | |
| 99.7% Al | Rainwater | ◎ | X | X | Yes |
| 99.7% Al | Brine | ◎ | ◎ | ◎ | No |

TABLE 5-continued

| Sprayed coating | Environment | Potential difference with steel Initial | 1 day later | 7 days later | Judgment (polarity reversal with steel occurs ?) |
|---|---|---|---|---|---|
| Arc-spraying/99.7% Al coating Comparison between plain water (rainwater) environment and brine environment | | | | | |
| 99.7% Al | Rainwater | ◎ | X | X | Yes |
| 99.7% Al | Brine | ◎ | ◎ | ◎ | No |

There were prepared, as samples, a sprayed coating composed of Al-5% Mg to which solutions were impregnated, and a sprayed coating composed of 99.7% Al to which solutions were impregnated. Table 6 shows a difference in potential between those two samples and a steel in rainwater environment.

It is understood in view of Table 6 that the samples to which the pre-treatment was carried out prior to sealing are able to keep a desired potential difference in rainwater environment, and hence, have a lengthened lifetime against rainwater.

TABLE 6

| Agent for impregnation | Spraying/ Sprayed material | Density [mol/liter] | Potential difference with steel Initial | 1 day later | 7 days later | Judgment (polarity reversal with steel occurs ?) |
|---|---|---|---|---|---|---|
| None | Plasma/ Al-5% Mg | — | ◎ | X | Δ | Yes |
| Sodium chloride | | 0.1 | ◎ | Δ | ○ | No |
| | | 1 | ◎ | ○ | ○ | No |
| Ammonium chloride | | 1 | ○ | ○ | ○ | No |
| Magnesium chloride (six hydrates) | | 0.1 | ◎ | ○ | Δ | No |
| | | 1 | ◎ | ◎ | ○ | No |
| | | 2.5 | ◎ | ◎ | ○ | No |
| Magnesium sulfate | | 0.1 | ◎ | ◎ | ◎ | No |
| | | 1 | ◎ | ◎ | ◎ | No |
| Magnesium nitrate | | 0.1 | ◎ | ◎ | ◎ | No |
| | | 1 | ◎ | ◎ | ◎ | No |
| None | Gas/ Al-5% Mg | — | ◎ | X | Δ | Yes |
| Magnesium chloride (six hydrates) | | 1 | ◎ | ○ | Δ | No |
| None | Arc/ Al-5% Mg | — | ◎ | X | Δ | Yes |
| Magnesium chloride (six hydrates) | | 1 | ◎ | ◎ | Δ | No |
| None | Plasma/ 99.7% Al | — | ◎ | X | Δ | Yes |
| Magnesium chloride (six hydrates) | | 1 | ◎ | ○ | Δ | No |

EXAMPLE 2

In Example 2, there were prepared sprayed coatings composed of Al-5% Mg. Water base paint to which electrolytic aqueous solutions each containing an agent are mixed was coated onto the sprayed coatings. The corrosion test was carried out to the sprayed coatings by exposing outdoors.

Table 7 shows the specification of the test samples.

TABLE 7

| Item | | Content |
|---|---|---|
| Test sample | Material | Black-skin steel plate (SS400) |
| | Size | 30 × 30 × 3.2t [mm] |
| Pre-treating | Blast Sa3 | |
| Spraying | Process | Plasma-spraying |
| | Sprayed material | Al-5% Mg (Φ1.6 mm) |
| | Coating thickness | 50 micrometers |
| Sealing | Water base paint | Odefresh Si100II (commercially available from Nippon Paint Inc.) |
| | Agent to be added (Density of aqueous solution: 1 mol/liter) | Sodium chloride<br>Ammonium chloride<br>Magnesium chloride<br>Magnesium sulfate<br>Magnesium nitrate |
| | Mixture ratio | Water base paint: aqueous solution of agent = 10:1 (weight ratio) |
| | Coating tool | Brush |

The test samples were exposed outdoors in a place in the sun (ordinary temperature). After starting exposing the test samples outdoors, rainwater was sprayed onto each of the test samples every 14 hours. A number of days in which the test samples were exposed outdoors was counted until the test samples were judged at eyes to be rusted. Rainwater is considered to be most close to ideal plain water in atmosphere. Furthermore, by designing a sprayed coating to have a thickness equal to a half of a thickness of a sprayed coating ordinarily formed in a construction, the test samples were facilitated to be rusted in the corrosion test.

Table 8 shows how much time is necessary for the test pieces to be rusted in outdoor environment. It is understood in view of FIG. 8 that the test samples to which the pre-treatment was carried out prior to sealing took a significantly greater number of days for starting being rusted than the test samples to which the pre-treatment was not carried out prior to sealing.

TABLE 8

| Agent to be added | Period of time until rusted |
|---|---|
| None | 10 minutes after sealed |
| Sodium chloride | 24 days after exposed outdoors |
| Ammonium chloride | 21 days after exposed outdoors |
| Magnesium chloride | 61 days after exposed outdoors |
| Magnesium sulfate | 40 to 50 minutes after sealed |
| Magnesium nitrate | 60 to 70 minutes after sealed |

INDUSTRIAL APPLICABILITY

The present invention is useful as a method of carrying out post-treatment to a sprayed coating formed for the purpose of prevent corrosion of steel materials containing iron as a primary constituent, such as carbon steel, nickel-chromium or stainless steel, used outdoors in a bridge, port facilities, a plant, a pipe, an advertising tower, a display tower, a train, and a ship, for instance, and further as an agent used in the method. In particular, the method and the agent both in accordance with the present invention are useful to steels used outdoors in which the steels are exposed to rainwater.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2010-212494 filed on Sep. 22, 2010 including specification, claims, drawings and summary is incorporated herein by reference in its entirety.

What is claimed is:

1. A method of carrying out post-treatment to a sprayed coating, comprising:

spraying an aluminum-magnesium alloy onto a surface of a steel for forming a sprayed coating on said steel, wherein said sprayed coating comprises aluminum-magnesium alloy; and coating either an electrolytic aqueous solution or a water base paint containing electrolytic aqueous solution therein onto said sprayed coating, wherein said electrolytic aqueous solution reaches a surface of said steel through spaces formed in said sprayed coating, wherein magnesium ions contained in said sprayed coating are caused to separate onto a surface of said steel to thereby form a coating containing magnesium hydroxide as a primary constituent, wherein a cell is formed between said steel and said sprayed coating, wherein said electrolytic aqueous solution comprises chloride aqueous solution, wherein chloride ions contained in said chloride aqueous solution activate cell reaction, and wherein aluminum contained in said sprayed coating prevents said sprayed coating from being in a passive state to keep a potential of said sprayed coating low.

2. A method of carrying out post-treatment to a sprayed coating, comprising:

spraying an aluminum-magnesium alloy onto a surface of a steel for forming a sprayed coating on said steel, wherein said sprayed coating comprises aluminum-magnesium alloy;

coating either an electrolytic aqueous solution or a water base paint containing electrolytic aqueous solution therein onto said sprayed coating;

drying said electrolytic aqueous solution; and coating a water base paint onto said sprayed coating, wherein said electrolytic aqueous solution reaches a surface of said steel through spaces formed in said sprayed coating, wherein magnesium ions contained in said sprayed coating are caused to separate onto a surface of said steel to thereby form a coating containing magnesium hydroxide as a primary constituent, wherein a cell is formed between said steel and said sprayed coating, wherein said electrolytic aqueous solution comprises chloride aqueous solution, wherein chloride ions contained in said chloride aqueous solution activate cell reaction, and wherein aluminum contained in said sprayed coating prevents said sprayed coating from being in a passive state to keep a potential of said sprayed coating low.

* * * * *